US005609253A

United States Patent [19]

Goade, Sr.

[11] Patent Number: 5,609,253

[45] Date of Patent: Mar. 11, 1997

[54] DATA CARD SECURITY DISPLAY PACKAGING

[75] Inventor: Ron E. Goade, Sr., Edmond, Okla.

[73] Assignee: SSI Photo I.D., Oklahoma City, Okla.

[21] Appl. No.: 497,578

[22] Filed: Jun. 30, 1995

[51] Int. Cl.[6] ..... B65D 75/00

[52] U.S. Cl. ..... 206/460; 206/449; 283/101

[58] Field of Search ..... 206/45.31, 45.28, 206/489, 460, 461, 467, 469, 449, 39; 283/101

[56] References Cited

U.S. PATENT DOCUMENTS

| | | | |
|---|---|---|---|
| 2,271,946 | 2/1942 | Miller | 206/460 X |
| 3,559,317 | 2/1971 | Knight et al. | 206/484 X |
| 4,168,002 | 9/1979 | Crosby | 206/461 X |
| 4,234,084 | 11/1980 | Huhen | 206/306 |
| 4,322,001 | 3/1982 | Hurley | 206/449 |
| 4,549,658 | 10/1985 | Sfikas | 206/461 X |
| 4,878,580 | 11/1989 | Johnston | 206/216 |
| 4,903,842 | 2/1990 | Tokuda et al. | 206/469 X |
| 4,915,231 | 4/1990 | Perbet et al. | 206/461 |
| 5,064,060 | 11/1991 | Connell et al. | 206/460 X |

FOREIGN PATENT DOCUMENTS

| | | | |
|---|---|---|---|
| 654529 | 2/1986 | Switzerland | 283/101 |

*Primary Examiner*—Jimmy G. Foster
*Attorney, Agent, or Firm*—Dunlap & Codding, P.C.

[57] ABSTRACT

A packaging and method for displaying a card having coded data disposed on one side thereof are provided. The packaging comprising an opaque backing and a transparent covering. The data card is disposed on one side of the backing with the coded data positioned against the backing and the covering laminated to a portion of the backing and the data card so as to seal the data card between the covering and the backing and mask the coded data on the data card.

11 Claims, 2 Drawing Sheets

DATA CARD SECURITY DISPLAY PACKAGING

BACKGROUND OF THE INVENTION

1. Field of the Invention

The present invention relates generally to packaging, and more particularly, but not by way of limitation, to an improved security packaging for displaying a data card having coded data disposed thereon.

2. Description of Related Art

The purchase and usage of data or information cards has continued to increase in recent years to the point that the sale of data cards today is a multi-billion dollar industry. Often data cards are printed and issued with a predetermined balance and typically sold as a retail item. An example of such a card is a prepaid calling card which provides an individual with a set dollar amount of long distance telephone calls. The account is accessed and debited by using an account number provided on the calling card.

In addition to the increased purchasing of data cards have come increased security problems. More specifically, when selling prepaid data cards as a retail item they are being displayed at the point of purchase in such a manner that access to the account numbers can be inconspicuously gained, and in turn used, without significantly damaging the packaging in which the card is displayed. To this end, a need exists for an improved security packaging for displaying a data card having coded data disposed thereon at the point of purchase. It is to such an improved security packaging that the present invention is directed.

DETAILED DESCRIPTION

Figure 1:
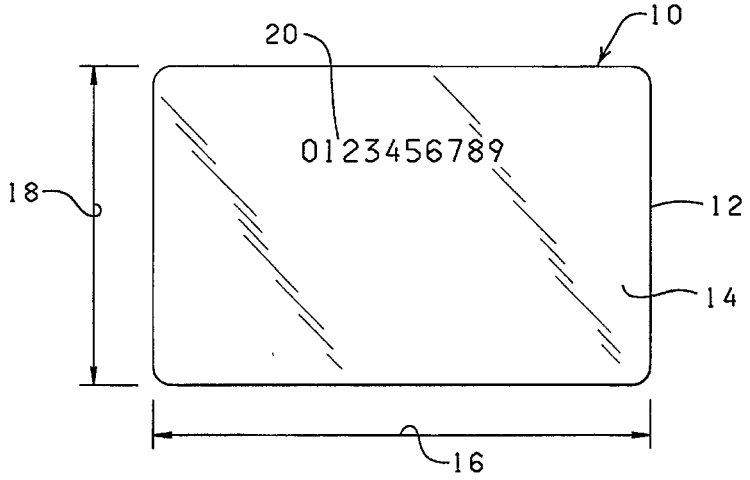
FIG. 1 is a back plan view of a data card.

Referring now to the drawings, and more particularly to FIG. 1, a data card 10 having a first side 12, a second side 14 a length 16, and a width 18 is illustrated. The data card 10 is provided with coded data 20 on the first side 12 or the second side 14 thereof. The coded data 20 is illustrated as being disposed on the second side 14 of the data card 10 in FIG. 1. The coded data 20 is further illustrated as being in the form of an account number or personal identification number which is utilized by an individual to charge the purchase goods or services to a prepaid account. It will be appreciated, however, that the coded data 20 may also be in the form of a magnetic stripe which contains information which is readable by a suitable card reader. Data cards and the use of same, as described hereinabove, are well known in the art. Thus, no further description of the types and uses of data cards is believed necessary in order to enable one skilled in the art to understand the present invention.

Figure 2:
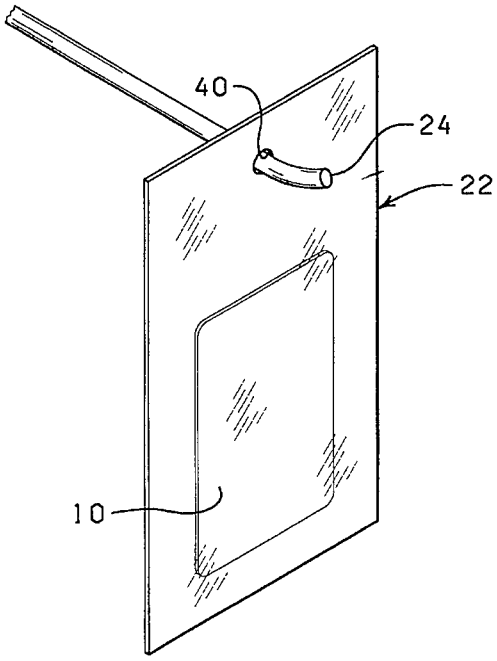
FIG. 2 is a perspective view of the data card sealed in a display packaging constructed in accordance with the present invention.

FIG. 2 shows a display packaging 22 constructed in accordance with the present invention hanging from a display peg 24. The display packaging 22 houses the data card 10 in such a manner that the coded data 20 on the data card 10 is masked and the data card 10 is sealed within the packaging 22 whereby the packaging 22 must be significantly destroyed to gain access to the coded data 20.

Figure 3:
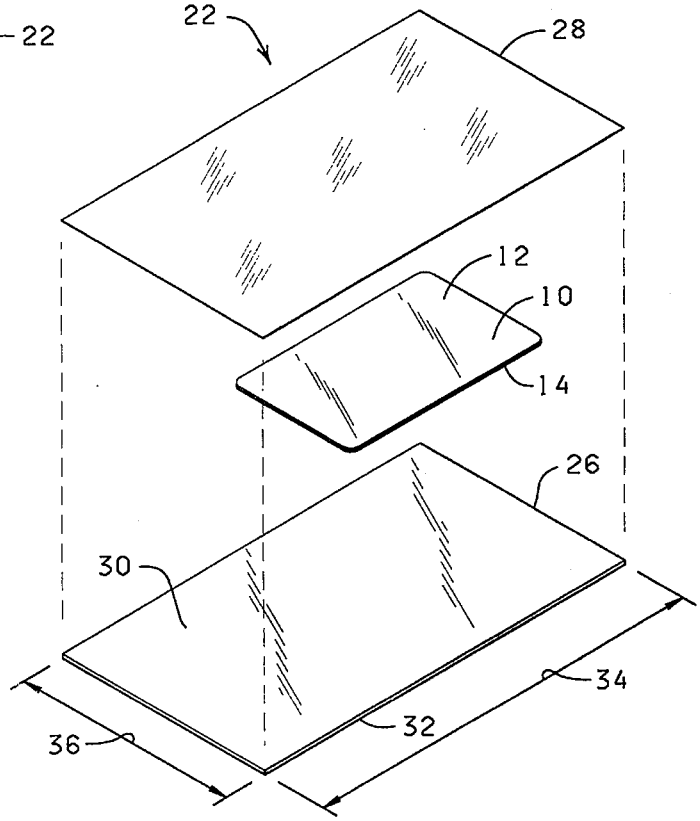
FIG. 3 is an exploded view of the packaging of the present invention and the data card of FIG. 1.
Figure 4:
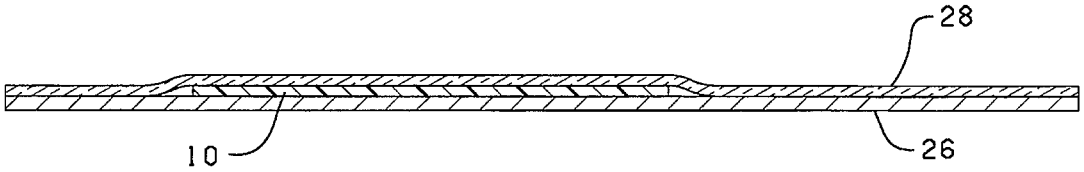
FIG. 4 is a cross sectional view of a data card shown sealed in the packaging of the present invention.

As best shown in FIGS. 3 and 4, the packaging 22 includes a backing 26 and a covering 28. The backing 26 is constructed of a sheet of material, such as a card stock, having an opaque characteristic and which is capable of receiving printed matter, such as art work and the name of the product and the distributor. The backing 26 is characterized as having a first side 30, a second side 32, a length 34 and a width 36. The backing 26 is illustrated herein as having a rectangular configuration; however, it will be appreciated that the backing 26 can be formed into any other desired geometric shape.

The backing 26 may be constructed of a single layer of material or a plurality of layers of the same or different types of materials. Any thickness of the backing 26 may be utilized in accordance with the present invention so long as at least a portion of the backing 26 is opaque so that the coded data 20 disposed on the data card 10 is not visible through the backing 26 when the data card 10 is sealed in the packaging 22 in a manner described below.

To facilitate sealing the data card 10 in the packaging 22, the length 34 of the backing 26 is greater than the length 16 of the data card 10 and the width 36 of the backing 26 is greater than the width 18 of the data card 10 such that a sufficient surface area of the backing 26 remains exposed about the data card 10 when the data card 10 is positioned on the backing 26 to enable the covering 20 to be secured to the backing 26.

The covering 28 is preferably a transparent plastic material capable of being laminated to both the backing 26 and the data card 10 so as to provide a secure seal about the data card 10. The covering 28 can be bonded to the backing 26 and the data card 10 in any suitable manner, such as by heat or pressure activation. Regardless of the manner of laminating the covering 28 to the backing 26 and the data card 10, it is important that the covering 28 be laminated to the backing 26 and the data card 10 in a nonresealable manner so that any tampering with the package 22 is revealed.

To seal the data card 10 in the packaging 22, the data card 10 is disposed on one side of the backing 26, which is pre-printed as desired. The data card 10 is disposed on the backing 26 with the coded data 20 of the data card 10 positioned against the backing 26. The covering 28 is then positioned over the data card 10 and the backing 26 and laminated to the exposed surface of the backing 26 and the exposed side of the data card 10 so as to seal the data card 10 between the backing 26 and the covering 28. When the data card 10 is sealed in the packaging 22 with the coded data 20 positioned against the opaque backing 26, the coded data 20 is sufficiently masked and the data card 10 is secured between the backing 26 and the covering 28 whereby the packaging 22 must be substantially mutilated to gain access to the coded data 20 on the data card 10.

The packaging 22 can be provided with a hole 40 (FIG. 2) near one end thereof to enable the packaging 22 to be displayed from the peg 24 or other similar device.

Figure 5:
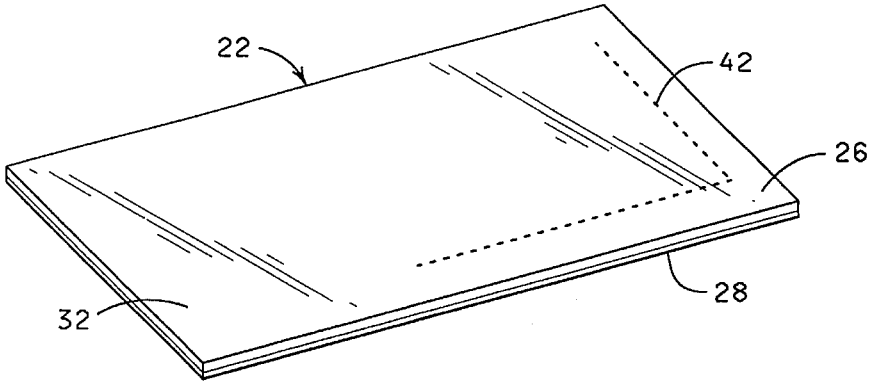
FIG. 5 is a perspective view of the back side of the packaging of the present invention.
Figure 6:
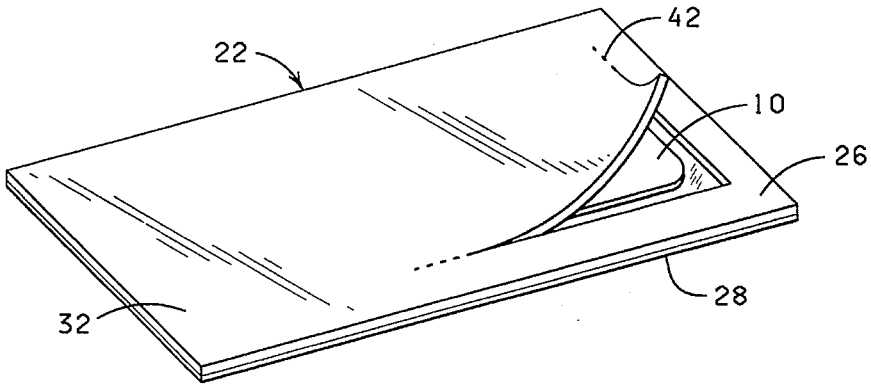
FIG. 6 is a perspective view of the back side of the packaging illustrating the removal of the data card from the packaging.

To aid in the removal of the data card 10 from the packaging 22, the backing 26 is perforated (as represented by the numeral 42 in FIG. 5) adjacent a portion of the data card 10 such that the perforations extend adjacent at least two adjacent edges of the data card 10. As illustrated in FIG. 6, the data card 10 is removed by tearing the backing 26 along the perforations and peeling the backing 26 from the covering 28 thereby exposing the data card 10.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A data card display packaging, comprising:

a backing having a first side and a second side, at least a portion of the backing being opaque;

a data card having coded data disposed on one side thereof, the data card disposed on the first side of the backing such that the coded data on the data card is positioned against the backing and masked from view by the backing; and a covering bonded to the backing and to the data card so as to seal the data card between the covering and the backing such that unauthorized tampering with the covering and the backing to gain access to the coded data on the data card is readily detectable.

2. The display packaging of claim 1 wherein the backing is perforated adjacent a portion of the data card to facilitate removal of the data card from between the backing and the covering.

3. The display packaging of claim 1 wherein the backing is perforated adjacent the data card such that the perforations extend adjacent at least two adjacent edges of the data card to facilitate removal of the data card from between the backing and the covering.

4. The display packaging of claim 1 wherein the covering is a transparent plastic material.

5. A data card display packaging, comprising:

an opaque backing characterized as having a first side and a second side;

a data card having coded data disposed on one side thereof, the data card disposed on the first side of the backing such that the coded data on the data card is positioned against the backing and masked from view by the backing; and a transparent covering bonded to a portion of the first side of the backing and to the data card so as to seal the data card between the covering and the backing such that unauthorized tampering with the covering and the backing to gain access to the coded data on the data card is readily detectable.

6. The display packaging of claim 5 wherein the backing is perforated adjacent a portion of the data card to facilitate removal of the data card from between the backing and the covering.

7. The display packaging of claim 5 wherein the backing is perforated adjacent a portion of the data card such that the perforations extend adjacent at least two adjacent edges of the data card to facilitate removal of the data card from between the backing and the covering.

8. The display packaging of claim 5 wherein the covering is a plastic material.

9. A method of packaging a data card having coded data on one side thereof, the method comprising the steps of:

disposing the data card on one side of an opaque backing such that the coded data on the data card is positioned against the backing and masked from view by the backing; and bonding a transparent covering to the backing and the data card so as to seal the data card between the covering and the backing such that unauthorized tampering with the covering and the backing to gain access to the coded data on the data card is readily detectable.

10. The method of claim 9 further comprising the step of:

perforating the backing adjacent a portion of the data card to facilitate removal of the data card from between the backing and the covering.

11. The method of claim 9 further comprising the step of:

perforating the backing adjacent a portion of the data card such that the perforations extend adjacent at least two adjacent edges of the data card to facilitate removal of the data card from between the backing and the covering.

* * * * *